US007219830B2

(12) United States Patent
West

(10) Patent No.: US 7,219,830 B2
(45) Date of Patent: May 22, 2007

(54) CONTAINER FOR SLICEABLE ICE CREAM

(76) Inventor: Duane E. West, Box 712, Garden City, KS (US) 67846

( * ) Notice: Subject to any disclaimer, the term of this patent is extended or adjusted under 35 U.S.C. 154(b) by 42 days.

(21) Appl. No.: 11/172,194

(22) Filed: Jun. 30, 2005

(65) Prior Publication Data

US 2007/0000979 A1 Jan. 4, 2007

(51) Int. Cl.
*B65D 5/08* (2006.01)
*B65D 5/42* (2006.01)
*B65D 5/12* (2006.01)

(52) U.S. Cl. ..... 229/115; 229/101.1; 229/905

(58) Field of Classification Search ..... 229/101, 229/101.1, 101.2, 115, 905; 426/111, 115
See application file for complete search history.

(56) References Cited

U.S. PATENT DOCUMENTS 928,423 A * 7/1909 Belson ..... 229/115
1,539,676 A * 5/1925 Labombarde ..... 229/905
1,567,594 A * 12/1925 Hitzert ..... 229/905
1,758,585 A * 5/1930 Riegel ..... 229/115
1,833,419 A 11/1931 Grossen
2,077,697 A * 4/1937 Hunt ..... 229/87.08
2,227,341 A 12/1940 Greenwood
2,255,492 A * 9/1941 Peters ..... 229/115
2,349,589 A * 5/1944 Harrington ..... 229/115
2,387,325 A * 10/1945 Goodyear ..... 229/236
3,199,765 A 8/1965 Locke
3,244,348 A 4/1966 Shaw
3,482,760 A 12/1969 Pascus et al.
3,493,122 A * 2/1970 McKee ..... 229/104
3,550,834 A 12/1970 McCall
3,653,576 A * 4/1972 Stranicky ..... 229/115
3,756,497 A 9/1973 Stewart
4,051,993 A * 10/1977 Castoldi, Jr. ..... 229/115
4,202,485 A 5/1980 Fremion
4,233,325 A 11/1980 Slangan et al.
4,253,601 A 3/1981 Kossoff
4,281,788 A 8/1981 Aeba
4,371,110 A * 2/1983 Kulig ..... 229/122
4,607,784 A 8/1986 Calabrese
5,042,657 A 8/1991 Dunn
5,062,542 A 11/1991 Morton
5,253,802 A 10/1993 Bernard et al.
5,337,947 A * 8/1994 Eskandry ..... 229/115
5,472,107 A 12/1995 Lieber

FOREIGN PATENT DOCUMENTS

JP 9-30590 A * 2/1997

* cited by examiner

*Primary Examiner*—Gary E. Elkins
(74) *Attorney, Agent, or Firm*—Chase Law Firm, L.C.

(57) ABSTRACT

A triangular ice cream carton having indicia for serving proportional slices of ice cream. The ice cream container includes a repositionable triangular insert to protect the sliced end of ice cream.

2 Claims, 2 Drawing Sheets

CONTAINER FOR SLICEABLE ICE CREAM

FIELD OF THE INVENTION

The present invention relates to containers for food products and, more particularly, to a triangular ice cream container with internal indicia to aid in dispensing ice cream portions.

BACKGROUND OF THE INVENTION

Containers for shipping and storage of various items are generally known in the art. Generally, triangular shaped containers heretofore have not been used for food items. Triangular shaped containers of the prior art are not particularly suited for food items, such as ice cream. Ice cream containers are primarily rectangular shaped cartons or cylindrical shaped tubs. These containers do not aid the user in proportionally or equally dispensing the contents.

SUMMARY OF THE INVENTION

The present invention includes a triangular-shaped ice cream container. The container includes a blank having three rectangular panels with eared flaps which are foldable to form the triangular container. An inside surface of the container includes indicia to aid the user in proportioning and serving the ice cream. Additionally, a movable side panel or insert protects the exposed end of the ice cream remaining in the container after a portion of the ice cream has been served.

DETAILED DESCRIPTION

Figure 1:
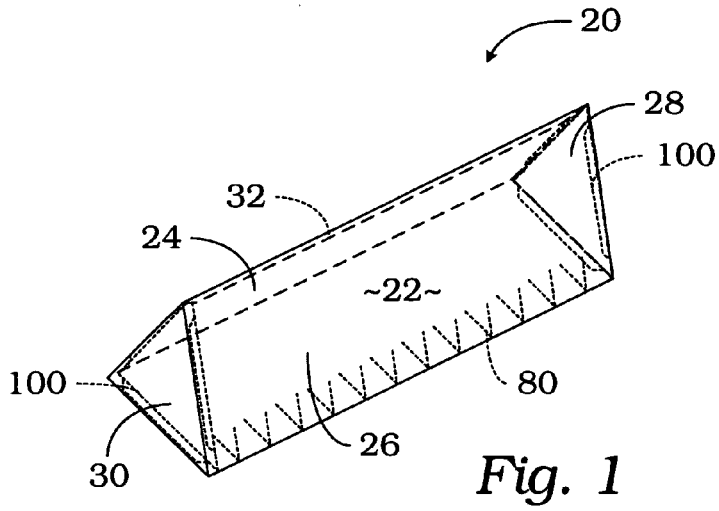
FIG. 1 is a perspective view of the container of the present invention.
Figure 2:
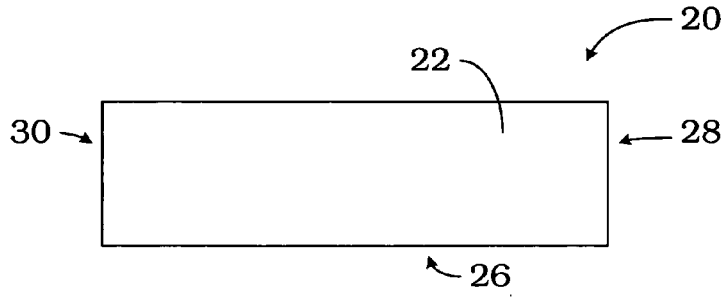
FIG. 2 is a front elevational view of the container of the present invention.
Figure 3:
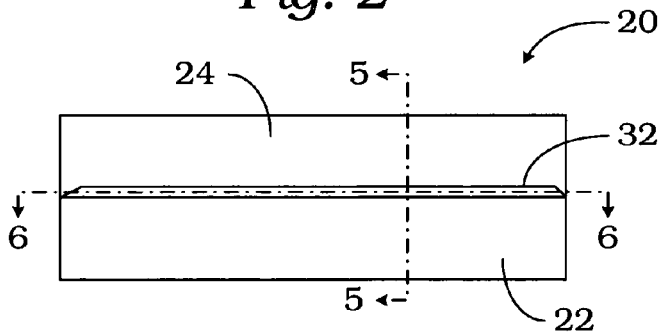
FIG. 3 is a top view of FIG. 2.
Figure 4:
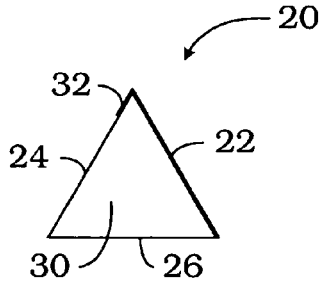
FIG. 4 is a side view of the container of FIG. 2.
Figure 5:
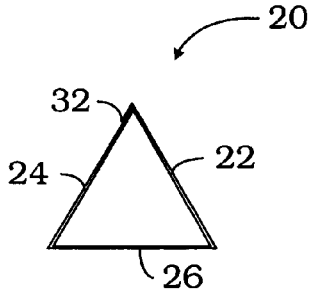
FIG. 5 is a sectional view of the container of FIG. 3 along line 5—5.

Referring to FIGS. 1–5, the container or carton of the present invention is generally indicated by reference numeral 20. Container 20 includes a front panel 22, a back panel 24, a bottom panel 26, and end panels 28 and 30. The front 22, back 24 and bottom 26 panels are rectangularly shaped to provide an elongated container. The end panels 28 and 30 are triangularly shaped to present a triangular shape to the elongated container 20. Front panel 22 includes a closure tab 32.

Figure 6:
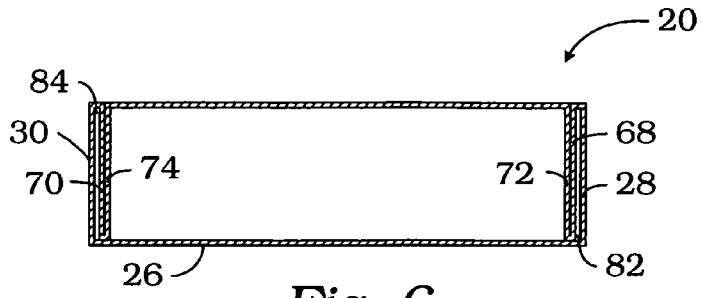
FIG. 6 is a sectional view of the container of FIG. 3 along line 6—6.

The container 20 is formed from a blank sheet of material which will be described with reference to FIGS. 6–8. The blank of material generally indicated by reference numeral 40, is formed of cardboard or other suitable material for making a container for ice cream, for example. The blank 40 includes a first transverse edge 42 and an opposing transverse edge 44. Longitudinally spaced between the transverse edges 42 and 44 are three generally parallel transverse fold lines 46, 48 and 50. Fold lines 46, 48 and 50 may be scored or depressed. The three fold lines 46, 48 and 50 separate the space between the transverse edges 42 and 44 into three rectangular panels 22, 24 and 26 and the closure tab 32.

At the lateral edges of panels 24 and 26 are formed trapezoid end panels 52 and 54. Fold lines 56 and 58 separate the trapezoid end panels 52 and 54 from panels 24 and 26. Within each trapezoid end panel are fold lines 60, 62, 64 and 66, which divide the trapezoid end panels 52 and 54 into triangular sections 28, 30, 68, 70, 72 and 74.

At the lateral ends of panel 22 are formed triangular end panels 76 and 78 separated from panel 22 by fold lines 56 and 58. Triangular end flaps 76 and 78 may be slightly smaller than the triangular sections 28, 30, 68, 70, 72 and 74. Spaced indicia 80 is printed on the surface of panels 22 and 26 over fold line 48.

The container 20 is formed by folding the blank 40 along the fold lines. Triangular end flaps 76 and 78 are folded upwardly along fold line 56 to form a right angle with panel 22. Closure tab 32 is folded upwardly along fold line 50. Trapezoid panels 52 and 54 are folded upwardly along fold lines 56 and 58 to form a right angle with panels 24 and 26. Triangular sections 68 and 72 on the right side of blank 40 and triangular sections 70 and 74 on the left side of blank 40 are folded inwardly along fold lines 60 and 62, respectively. At the same time, triangular sections 28 and 68 on the right side and triangular sections 30 and 70 are folded outwardly along fold lines 64 and 66, respectively, and panel 24 is folded forward along fold line 46.

Fold lines 60 and 62 are folded down until they make contact with fold lines 56 and 58, respectively. The back surfaces of triangular sections 72 and 68 and sections 74 and 70 may be glued together and along fold lines 60, 62, 56 and 58.

Slots 82 and 84 are formed on each side of the container 20 between triangular sections 28 and 68 and triangular sections 30 and 70, respectively. When the front panel 22 is folded upwardly along fold line 48, the triangular flaps 76 and 78 slip into the slots 82 and 84 to seal the contents of the container 20. The closure tab 32 is folded over the top of the container 20 along fold line 50 and sealed to the rear panel 24.

Figure 7:
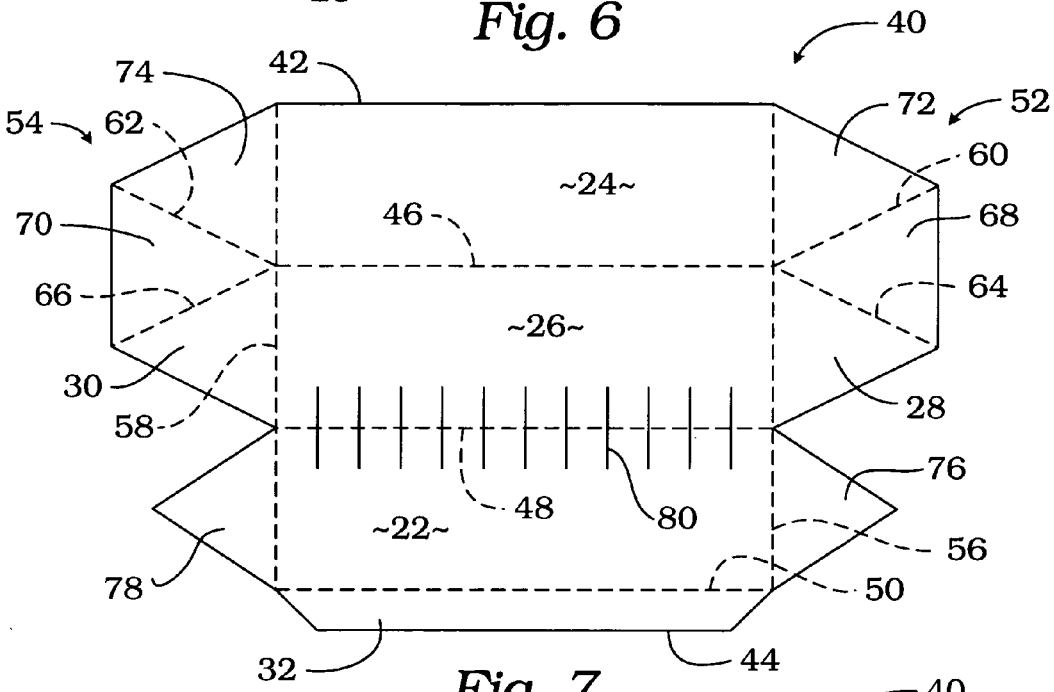
FIG. 7 is a plan view of a blank sheet of material which is utilized to form the container of the present invention.
Figure 8:
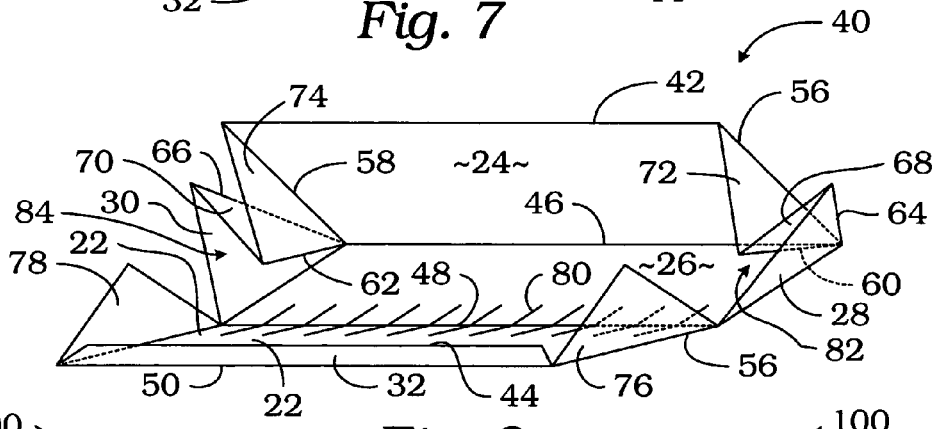
FIG. 8 is a perspective view of FIG. 1 showing a partial assembly of the container.
Figure 9:
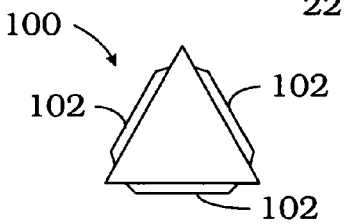
FIG. 9 is a plan view of an end cap insert.
Figure 10:
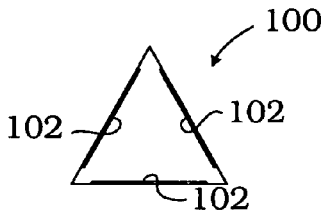
FIG. 10 is a side view of the end cap insert of FIG. 9.

Referring to FIGS. 1, 7 and 10, repositioned internal end caps 100 may be included with the container 20. End caps 100 are sized and shaped to match the interior cross-sectional dimension of the container 20 and include tabs 102 to keep the end cap upright within the container 20. The end cap 100 aids in keeping the ice cream fresh as it is consumed. When the container 20 is first opened, the person serving the ice cream uses a knife to cut the ice cream. The server may use the indicia 80 to serve the same portion of ice cream. If all of the ice cream is not served, the server slides the end cap 100 against the exposed end of ice cream to keep the ice cream fresh and avoid freezer burn. The front panel 22 is closed and the ice cream may be then returned to the freezer. Advantageously, the triangular shape of the sliced ice cream may be placed on a piece of pie for a delightful ice cream and pie dessert.

It is to be understood that while certain forms of this invention have been illustrated and described, it is not limited thereto, except in so far as such limitations are included in the following claims and allowable equivalents thereof.

The invention claimed is:

1. A container for ice cream comprising:

a rectangular base panel, a rectangular rear panel foldably connected to said rectangular base panel along a first longitudinal fold line, a rectangular front panel connected to said rectangular base panel along a second longitudinal fold line opposite said first longitudinal fold line, a closure tab connected to said front panel along a third longitudinal fold line opposite said second longitudinal fold line, a first trapezoid panel connected to said rear panel and said base panel along a first transverse fold line, a second trapezoid panel connected to said rear panel and said base panel along a second transverse fold line opposite said first transverse fold line, a first triangular end panel connected to said front panel along said first transverse fold line, a second triangular end panel connected to said front panel along said second transverse fold line, said first trapezoid panel being foldably divided into three triangular sections, said second trapezoid panel being foldably divided into three triangular sections, a plurality of spaced-apart indicia generally parallel to said transverse fold lines and intersecting said second longitudinal fold line.

2. The container as set forth in claim 1 further comprising a repositionable triangular insert.

* * * * *